US005289791A

United States Patent [19]

Sanders et al.

[11] Patent Number: 5,289,791

[45] Date of Patent: Mar. 1, 1994

[54] SEWING MACHINE WITH THREAD WIPER AND AUXILIARY CUTTER

[75] Inventors: Michael S. Sanders, Grand Rapids; Leon L. Reister, Ionia, both of Mich.

[73] Assignee: General Motors Corporation, Detroit, Mich.

[21] Appl. No.: 40,541

[22] Filed: Mar. 31, 1993

[51] Int. Cl.[5] ..... D05B 65/02

[52] U.S. Cl. ..... 112/262.1; 112/290; 112/291; 112/300; 112/286; 112/324

[58] Field of Search ..... 112/290, 291, 292, 301, 112/300, 324, 286, 262.1

[56] References Cited

U.S. PATENT DOCUMENTS

| | | | |
|---|---|---|---|
| 3,756,177 | 9/1973 | Landwehr | 112/252 |
| 4,181,088 | 1/1980 | Kessler et al. | 112/292 |
| 4,187,792 | 2/1980 | Boser et al. | 112/286 |
| 4,478,163 | 10/1984 | Keeton | 112/287 |
| 5,005,504 | 4/1991 | Albrecht et al. | 112/291 X |
| 5,027,731 | 7/1991 | Sato et al. | 112/286 |
| 5,042,408 | 8/1991 | Suzuki et al. | 112/292 |
| 5,048,436 | 9/1991 | Thiele | 112/228 |
| 5,062,374 | 11/1991 | Wokeck et al. | 112/130 |
| 5,080,031 | 1/1992 | Suzuki et al. | 112/286 |
| 5,113,774 | 5/1992 | Dusch et al. | 112/292 |
| 5,125,351 | 6/1992 | Prais et al. | 112/292 |
| 5,131,340 | 7/1992 | Tajima et al. | 112/292 |
| 5,144,901 | 9/1992 | Suzuki | 112/291 X |
| 5,176,084 | 1/1993 | Keeton | 112/288 |

*Primary Examiner*—Peter Nerbun
*Assistant Examiner*—Paul C. Lewis
*Attorney, Agent, or Firm*—Ernest E. Helms

[57] ABSTRACT

A double-stitch sewing machine is provided which, in a preferred embodiment, includes a throat plate and feed dog with a needle opening for supporting a material to be sewn, a reciprocating needle to penetrate the material, the needle having an eyelet for insertion of a needle thread, the needle being able to penetrate through the sewn material and carry the needle thread through the needle opening, a rotating hook for pulling on the needle thread after insertion of the needle thread through the needle opening, forming a loop in the needle thread with a first leg of the loop being joined with the sewn material and the needle and a second leg of the loop being joined only with the sewn material, a bobbin carrier mounted within the rotating hook having an adjacent clearance with the rotating hook, allowing the rotating hook to cause the needle thread to be brought underneath the bobbin carrier, the bobbin carrier dispensing bobbin thread in cooperation with the rotating hook pulling of the needle thread, a first cutter for cutting the needle thread, separating the needle thread first and second legs and cutting the bobbin thread, forming a first leg of the bobbin thread connecting with the bobbin and a second leg of the bobbin thread connecting with the sewn material, the first cutter insuring a predetermined length of the needle thread first leg, a thread wiper for pulling on the first leg of the needle thread, insuring a minimum length of the first leg of the needle thread on a side of the throat plate adjacent the sewn material, and a second cutter generally adjacent the needle opening on a side of the throat plate opposite the sewn material to sever the second leg of the needle thread and the second leg of the bobbin thread more adjacent to the sewn material.

11 Claims, 4 Drawing Sheets

SEWING MACHINE WITH THREAD WIPER AND AUXILIARY CUTTER

FIELD OF THE INVENTION

The field of the present invention is that of lock-stitch type sewing machines and methods of utilization thereof. Specifically, the present invention involves an apparatus and a method of utilization thereof which minimizes the length of the material which is left after the sewing process.

BACKGROUND OF THE INVENTION

Most cross-stitch sewing machines have a bed plate for supporting the material and a needle with a cross aperture or eyelet which penetrates the material and then enters a needle opening in the bed plate. The needle opening (where the needle penetrates the plane of the bed plate) in one configuration is through a hole in a feed dog (supported underneath the bed plate) or in a throat plate (supported on a slot on the bed plate), depending on the material feed system utilized. Under the bed plate is a rotating hook sometimes referred to as a looper. The hook may rotate on a vertical or horizontal axis. The hook has mounted in its top a nonrotative bobbin carrier. Between the bobbin carrier and the hook, there is a clearance underneath the bobbin carrier.

When the needle penetrates the material to be sewn, it carries the needle thread to a position underneath the bed plate and then slightly rises. This action causes the needle thread to slightly buckle, allowing it to be engaged by the hook. The hook causes the loop, which is now formed in the needle thread, to be enlarged and for a portion of the loop in the needle thread to come underneath the bobbin carrier. The bobbin carrier contains a spool of bobbin thread which becomes entrapped by the loop of the needle thread. The bobbin thread is carried up to a position adjacent the bottom of the sewn material, forming a pattern of a cross stitch. A more detailed understanding of the workings of cross-stitch sewing machines can be gained from a reading of Landwehr U.S. Pat. No. 3,756,177, Thiel U.S. Pat. No. 5,048,436 and Kessler et al U.S. Pat. No. 4,181,088, the disclosures of which are incorporated herein. At the end of the sewing process, either by manual actuation or by some type of control logic which is monitoring the sewing operation, a rotary or arcuate knife cutter is engaged to cut the bobbin and needle threads.

Most cutters work on the principle of a scissors-type mechanism with movement by a pivotal or rotational arm grabbing the threads and making the threads engage with a stationary knife. To allow the threads which are still connected with the material to be as short as possible and therefore delete or minimize a requirement for a secondary thread cutting operation (after the sewn material has been removed from the sewing machine), it is desirable that the threads at the end of the sewing operation be cut adjacent to the needle opening in the bed plate (which will be a feed dog hole in many industrial, nongarment sewing machines) as much as possible. However, there are two constraints which prevent cutting of the needle thread and bobbin thread adjacent to the needle opening. The first constraint is that the stationary knife typically is located away from the needle opening due to required clearances of moving parts of the sewing machines, including but not limited to the feed dog and hook. Secondly, the portion of the needle thread from the eyelet of the needle to its cut end must be of a minimum length to insure proper operation on the next sewing cycle. Unfortunately, the above two constraints leave a length of the needle thread and the bobbin thread, which are still connected with the sewn material, of the approximate same length as the needle thread which is threaded through the needle eyelet. Therefore, there exists a challenge of providing a sewing machine which can allow an appropriate length of needle thread which is threaded through the needle eyelet after the cutter has cut the needle and bobbin threads and still minimize the length of the needle and bobbin threads which are now connected with the material workpiece which has been sewn.

SUMMARY OF THE INVENTION

To meet the above-noted challenge and to provide a sewing machine which provides an alternative to the patents noted herein, the present invention is brought forth. The present invention provides a sewing machine which can utilize a conventional moving-type thread cutter which insures the appropriate length of thread which is still threaded through the needle eyelet while at the same time providing a wiper to remove the needle thread still associated with the needle. The present invention also provides an auxiliary cutter, preferably an electric one, which severs the needle thread and the bobbin thread, which are still connected with the sewn material. The secondary cutter operation cuts the threads still connected with the sewn material so close that the prior trimming operation required on many items sewn with prior conventional sewing machines is now eliminated.

An object of the present invention is to provide an improved sewing machine and process which minimizes the length of the threads still connected with the material after completion of the sewing operation.

DESCRIPTION OF THE PREFERRED EMBODIMENTS

Figure 1:
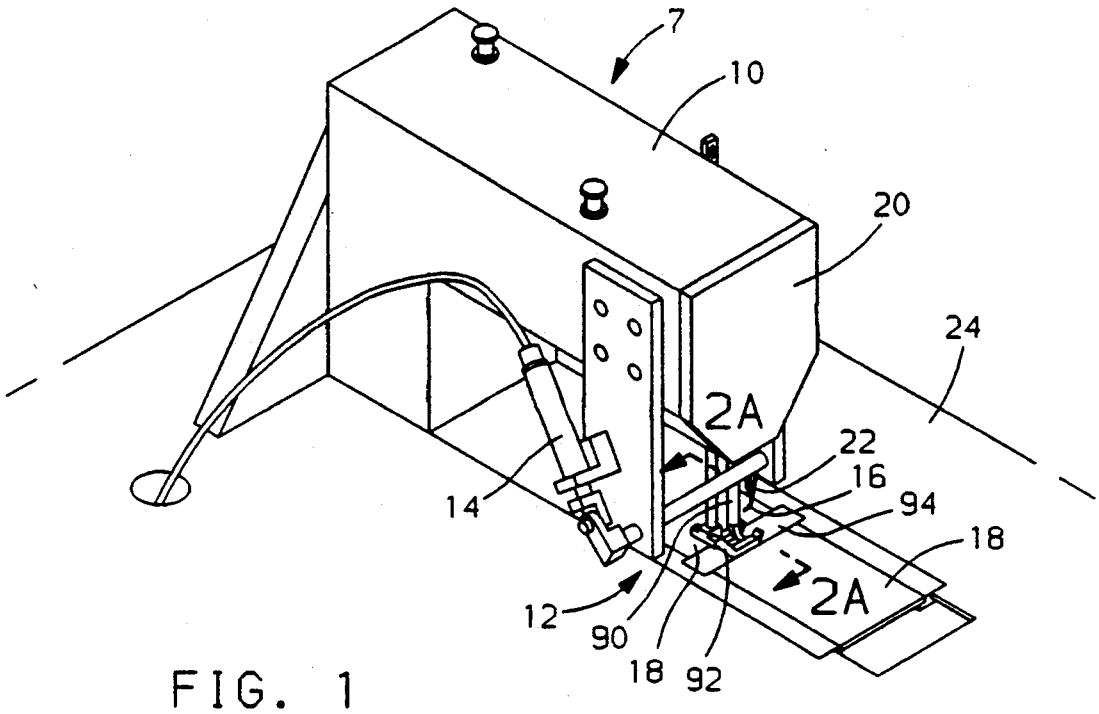
FIG. 1 is a perspective view of a preferred embodiment sewing machine according to the present invention.
Figure 2A:
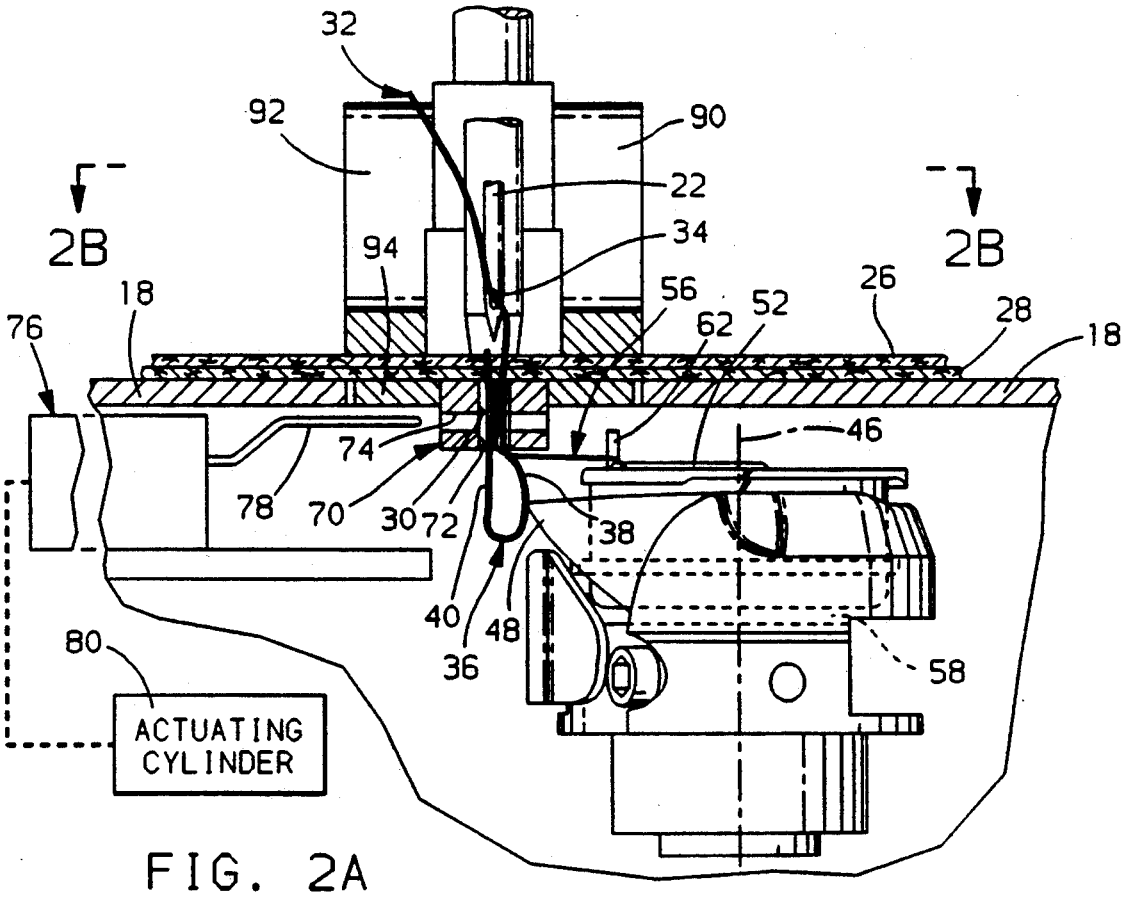
FIG. 2A is a view taken along line 2A—2A of FIG. 1.
Figure 2B:
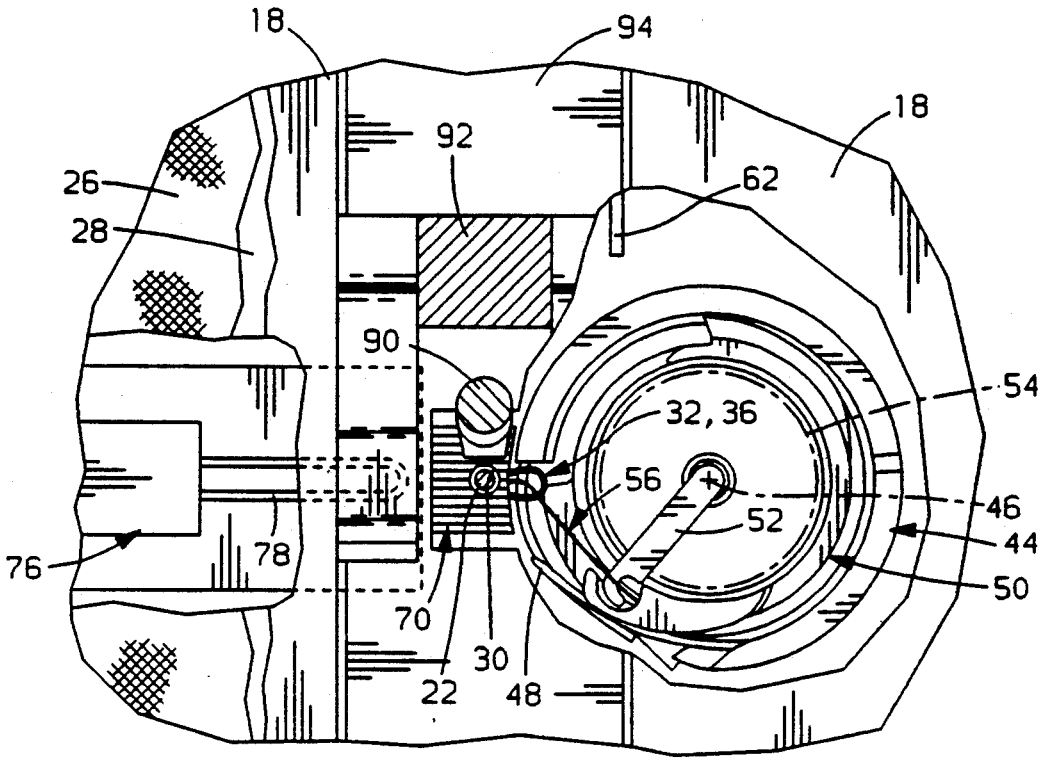
FIG. 2B is a view taken along line 2B—2B of FIG. 2A.

Referring to FIGS. 1, 2A and 2B, the sewing machine 7 of the present invention is shown in one of its preferred embodiments. The sewing machine 7 has an overhanging arm 10, the end of which forms a head 20. The head 20 supports and powers a reciprocating needle 22. The head also supports the pressure feet 92 and a vibrating foot 90. The sewing machine 7 also has a conventional bed plate 24 which has a slide plate 18 to allow access to the working portions of the machine, which are located underneath the bed plate 24.

Adjacent to and supported on a milled slot in the bed plate 24 is a throat plate 94. The throat plate has a central aperture which allows for room for an alignment fixture or feed dog 70. The feed dog 70 is supported underneath the bed plate 24 by a structure (not shown) and moves in an elliptical fashion. In cooperation with the vibrating foot 90, pressure feet 92 provide a material feeding system for the material. The bed plate 24, slide plate 18 and throat plate 94 provide a supporting surface for the material 26 and 28 which is to be sewn together. The feed dog 70 also has an aperture 72 coterminous with a needle opening 30 which allows penetration of the needle 22 below the plane of the bed plate 24. However, the present invention is not limited to configurations wherein the needle opening is coterminous with an aperture in the feed dog. In other embodiments (not shown), the needle opening may be directly in the throat plate (more typical in garment-type sewing machines). The sewing machine also has a thread wiper 12 which is powered by an air cylinder 14 having a blade 16 for interaction with the needle thread 32 in a manner to be described later.

Referring additionally to FIG. 2B, the needle 22 has a cross bore or eyelet aperture 34 which is threaded with the needle thread 32. The needle 22 will be projected through the sewn material 26 and 28 and then will be raised out of the material in a reciprocating manner. The above will cause a loop 36 to be formed in the needle thread 32. A first leg 38 of this loop 36 will be associated with the material 26 and 28 and the needle cross bore 34, and a second leg 40 of the loop 36 will be associated only with sewn material 26 and 28. To engage with the loop 36 there is provided a rotating hook or a commonly referred to looper 44. The looper 44 as shown rotates on a vertical axis 46 generally parallel to the needle 22 and has a blade 48 for insertion into the loop 36. In other versions of the present invention (not shown), the rotating hook 44 can be situated with an axis generally perpendicular to the needle 22.

The rotating hook 44 has mounted therein a bobbin carrier 50. The bobbin carrier is held in a nonrotative manner by a fixture (not shown) and therefore does not rotate with the rotating hook 44. Within the bobbin carrier 50 is a bobbin spool 54 which has wound therein a bobbin thread 56. A bobbin tensioning mechanism 52 aids in tensioning the bobbin thread and dispensing the bobbin thread in conjunction with the movement of the needle thread 32 by the rotating hook 44. The rotating hook 44 has a clearance 58, with the bobbin carrier 50. Rotation of the hook 44 in a clockwise manner as shown in FIG. 2B will cause the blade 48 to engage with the needle thread loop 36, causing the second leg 40 of the loop to extend over the top of the bobbin carrier 50 and for the first leg 38 of the needle thread to be extended within the clearance 58, underneath the bobbin carrier 50. (As used in this description, the term "underneath the bobbin carrier" also extends to embodiments of the present invention, not shown, wherein the loop shaft rotates on an axis generally parallel with the plane of the bed plate. In such above-noted instances, the term "underneath the bobbin carrier" generally refers to a side of the bobbin carrier least adjacent to the needle.) The enlargement and subsequent contraction of the loop 36 of the needle thread will cause it to grab hold of the bobbin thread 56 and pull the bobbin thread to a position between the material 28 and the throat plate 18 after being pulled through the needle opening 30.

Figure 3A:
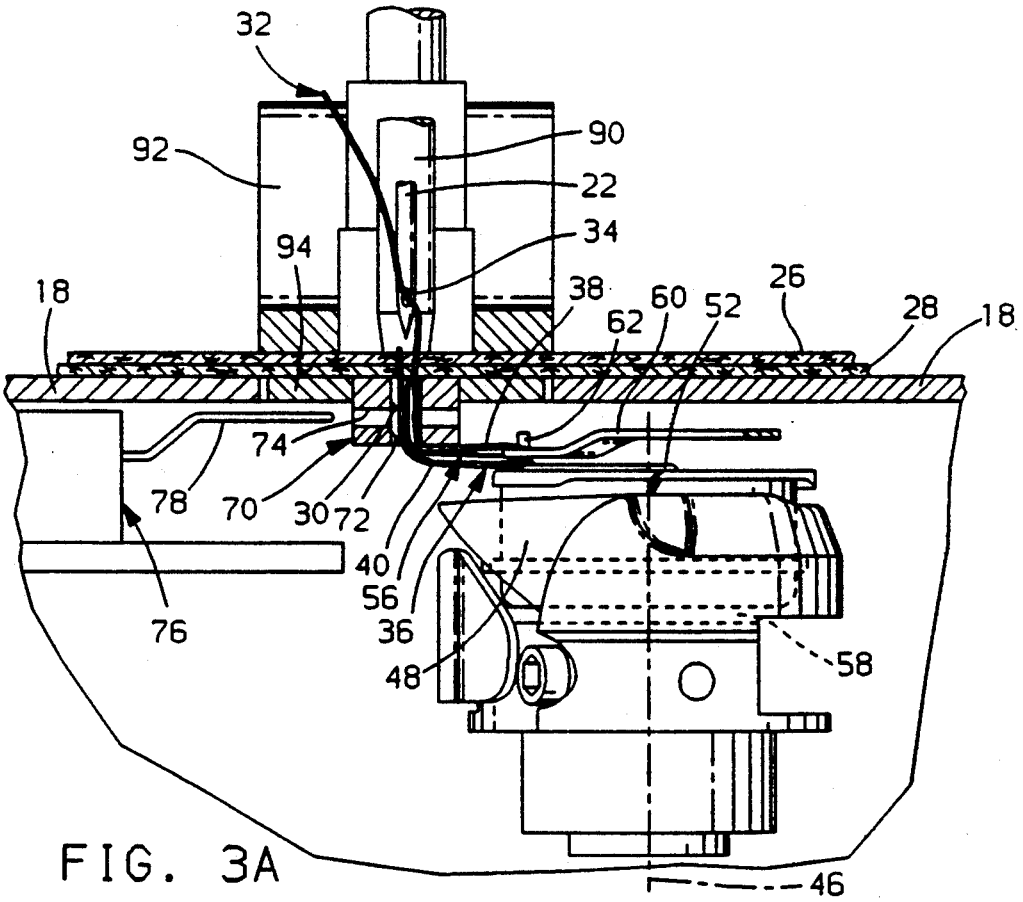
FIG. 3A and 3B are views similar to 2A and 2B but further showing illustration of the pivoting knife mechanism.
Figure 3B:
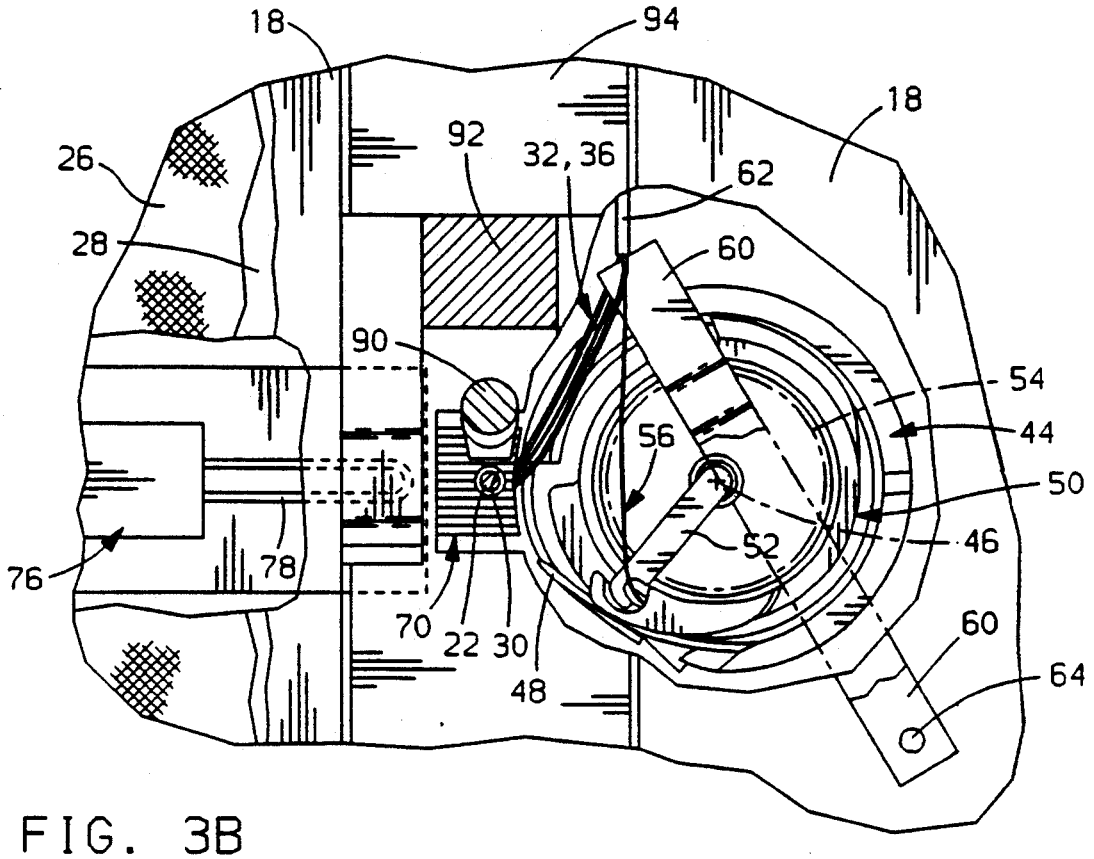
Figure 4A:
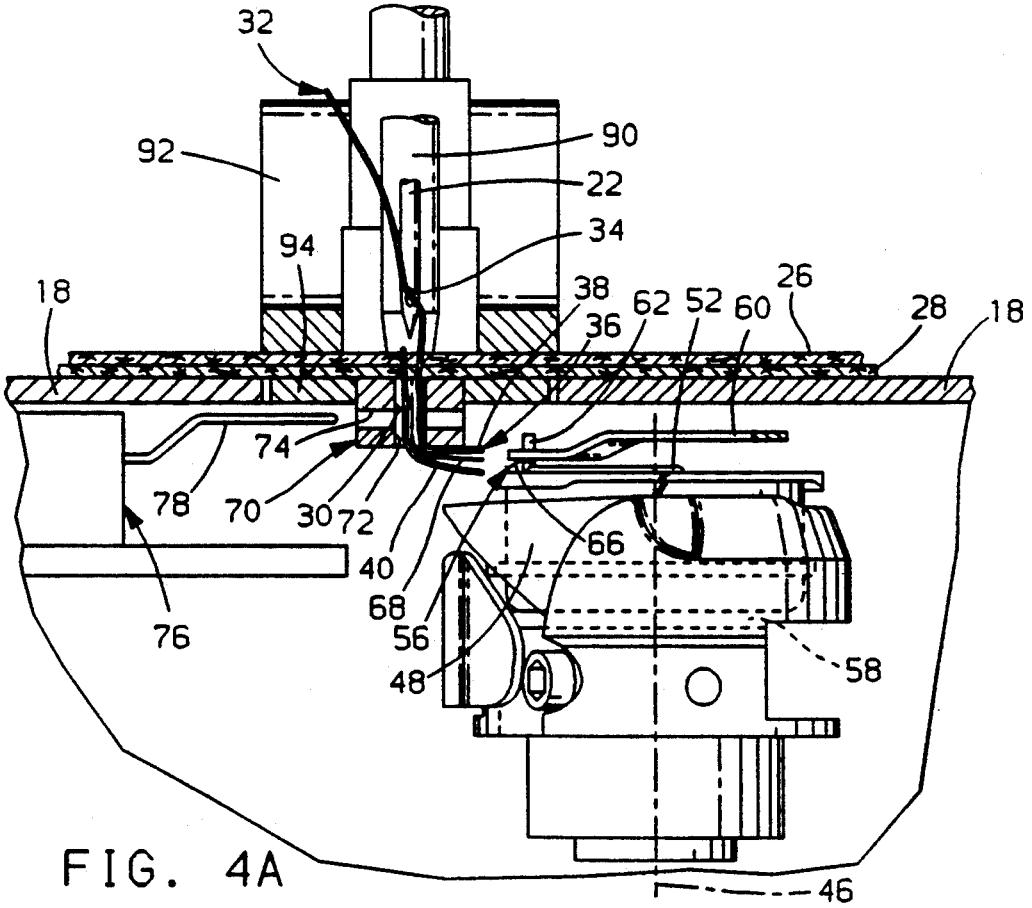
FIGS. 4A, 5A and 6A are views similar to FIG. 2A showing progressive later stages of the operation of the present invention.

Referring additionally to FIGS. 3A, 3B and 4A, after completion of the sewing cycle, either upon actuation by the operator or by an automatic control, a conventional motion like thread cutting knife will be actuated. The conventional knife has a pivotally moving thread-pulling blade 60 which pivots about a pin 64 in a conventional manner (in a plane generally parallel with the throat plate 18), pulling the needle thread 32 and the bobbin thread 56 over to a stationary knife blade 62 wherein the interactions of the knife blades 60, 62 cut the needle 32 and bobbin 56 threads. To insure a proper length of thread in the first leg 38 of the needle thread, the steel blade 62 has to be a minimum length from the needle opening 30. The bobbin thread 56 is also severed into a first leg 66, which is connected with the bobbin spool 54 within the bobbin carrier 50, and a second leg 68, which is connected with the sewn material 28.

Figure 5A:
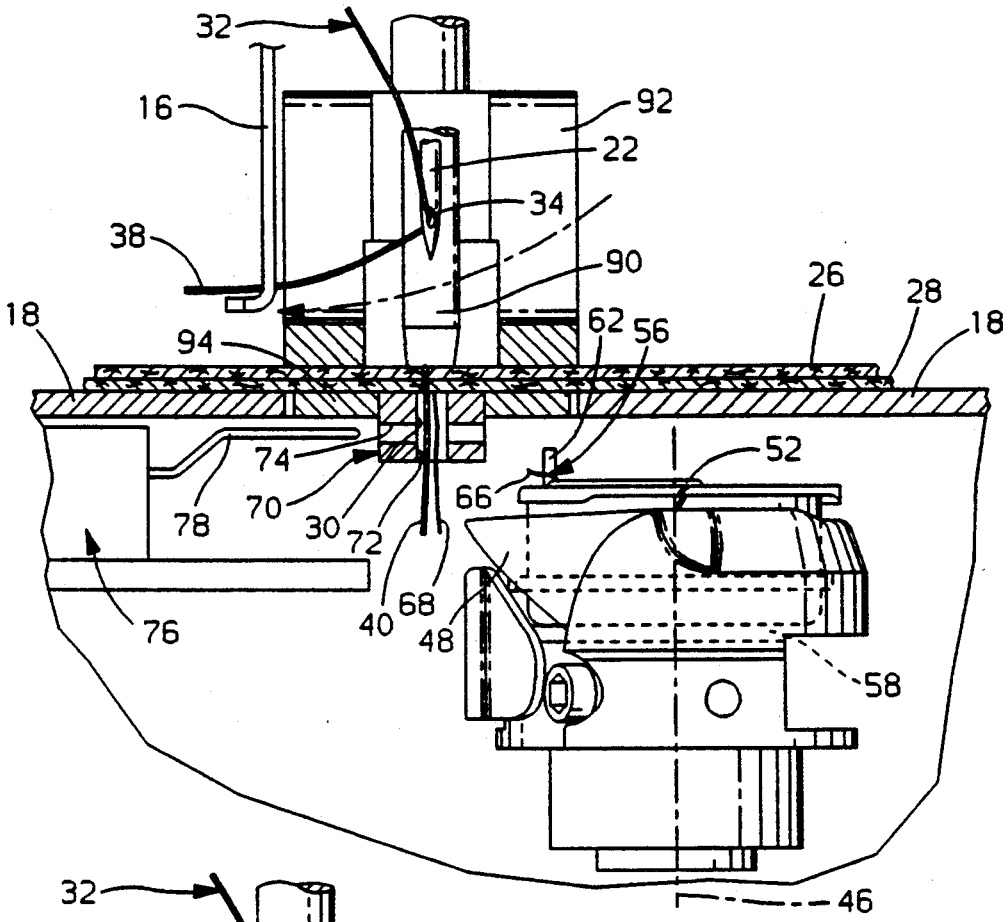
Figure 6A:
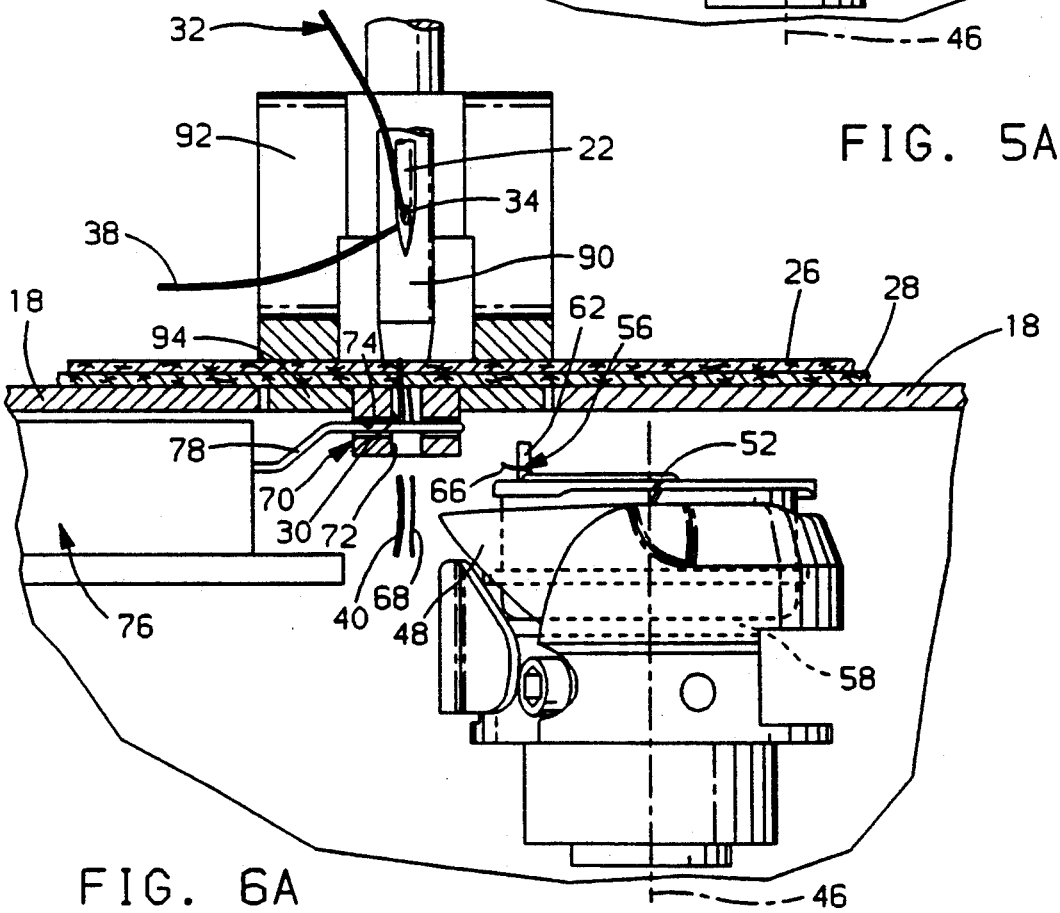

Referring additionally to FIGS. 5A and 6A, the blade 16 of the thread wiper 12 is actuated by the cylinder 14, insuring a minimum length of the first leg 38 of the needle thread being on a side of the throat plate 18 adjacent to the material 26 and 28. As best shown in FIG. 5A, the needle thread second leg 40 and bobbin thread second leg 68 are longer than what is desirable at this point.

As mentioned previously, adjacent the needle opening 30 is the feed dog 70. The feed dog 70 has a transverse bore or slot 74 which intersects the aperture 72. An electric knife 76 having a heated blade 78 is reciprocally powered by cylinder 80 (shown schematically in FIG. 2A) and actuated to insert itself within the feed dog 70 to sever the second legs 40, 68 of the needle thread 32 and the bobbin thread 36 to a position more adjacent to the sewn material 28. The aperture 72 and transverse bore or slot 74 of the feed dog 70 constitute an electric knife alignment fixture. It has been found that such a severance can be made so close that a further trimming operation is no longer needed. Additionally, to minimize the heat effects, the circuit which powers the electric blade 78 has a dual transformer system so that the electric blade 78 maintains a dwell temperature of approximately 400° F. Then, on activated signal, the temperature is increased to a cutting temperature of 900° F., thereby minimizing the heat output of the electric knife 76 when it is not being actuated.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A double-stitch sewing machine comprising:

plate means for supporting a material to be sewn, the plate means having a needle opening;

a reciprocating needle to penetrate the material, the needle having a generally transverse aperture for insertion of a needle thread, the needle being able to penetrate through the sewn material and carry the needle thread through the needle opening;

a rotating hook for pulling on the needle thread after insertion of the needle thread through the needle opening, forming a loop in the needle thread with a first leg of the loop being joined with the sewn material and the needle and a second leg of the loop being joined only with the sewn material;

a bobbin carrier mounted within the rotating hook having an adjacent clearance with the rotating hook, allowing the rotating hook to cause the needle thread to be brought underneath the bobbin carrier, the bobbin carrier also having a bobbin spool means with bobbin thread and having bobbin thread dispensing means which dispenses bobbin thread in cooperation with the rotating hook pulling of the needle thread;

first cutter means for cutting the needle thread, separating the needle thread first and second legs and cutting the bobbin thread, forming a first leg of the bobbin thread connecting with the bobbin and a second leg of the bobbin thread connecting with the sewn material, the first cutter means insuring a predetermined length of the needle thread first leg;

thread wiper means for pulling on the first leg of the needle thread, insuring a minimum length of the first leg of the needle thread on a side of the plate means adjacent the sewn material; and second cutter means generally adjacent the needle opening to sever the second leg of the needle thread and the second leg of the bobbin thread more adjacent to the material.

2. A sewing machine as described in claim 1 wherein the first cutter means includes a moving knife which engages the threads with a stationary knife.

3. A sewing machine as described in claim 2 wherein the moving knife moves in a plane generally perpendicular to the needle.

4. A sewing machine as described in claim 1 wherein the second cutter means includes an electric hot wire knife.

5. A sewing machine as described in claim 4 wherein the electric knife has a multi-stage transformer, allowing it to have at least two separate temperatures of operation.

6. A sewing machine as described in claim 4 wherein the electric knife can be reciprocated in a linear motion.

7. A sewing machine as described in claim 4 having an electric knife alignment fixture with a first bore aligned with the needle opening and a second slot for alignment of the electric knife for penetration through the needle opening to sever the second leg of the needle thread and the bobbin thread.

8. A double-stitch sewing machine comprising:

a plate for supporting a material to be sewn, the plate having a needle opening;

a reciprocal needle to penetrate the material, the needle having a generally transverse aperture for insertion of a needle thread, the needle penetrating through the sewn material and carrying the needle thread through the needle opening;

a rotating hook for pulling on the needle thread after insertion of the needle thread through the needle opening, forming a loop in the needle thread with a first leg of the loop being joined with the sewn material and the needle and a second leg of the loop being joined only with the sewn material;

a bobbin carrier mounted within the rotating hook having an adjacent clearance with the rotating hook, allowing the rotating hook to cause the needle thread to be brought underneath the bobbin carrier, the bobbin carrier also having a bobbin spool means with bobbin thread and bobbin thread dispensing means which dispenses bobbin thread in cooperation with the rotating hook pulling of the needle thread;

a first cutter including a moving knife for engaging the needle thread and the bobbin thread with a stationary knife, the first cutter separating the needle thread first and second legs and cutting the bobbin thread, forming a first leg of the bobbin thread connected with the bobbin spool means and a second leg of the bobbin thread connected with the sewn material, the first cutter insuring a predetermined length of the needle thread first leg;

a thread wiper for pulling on the first leg of the needle thread after the needle thread has been severed by the first cutter, insuring a minimum length of the first leg of the needle thread on a side of the plate adjacent the sewn material;

an alignment fixture having a first bore generally adjacent with the needle opening for passage of the needle and bobbin threads and having intersecting with the first bore a second passage providing for alignment; and a movable electric knife insertable within the alignment fixture second passage, allowing for severance of the second legs of the needle thread and the bobbin thread after the thread wiper has removed the first leg of the needle thread, allowing the second leg of the needle thread and the bobbin thread to be severed more adjacent to the material.

9. A sewing machine as described in claim 1 wherein the rotating hook has a rotational axis generally parallel with the reciprocating needle.

10. A method of double-stitch sewing of a material comprising:

supporting the material to be sewn on a plate having a needle opening;

reciprocally penetrating the material with a needle which has a generally transverse aperture for insertion of a needle thread, the needle also penetrating through the needle opening;

rotating a hook and pulling on the needle thread after the insertion of the needle thread through the plate, forming a loop in the needle thread with a first leg of the loop being joined with the material and the needle and a second leg of the loop being joined only with the material;

mounting within the rotating hook a bobbin carrier having an adjacent clearance with the rotating hook, allowing the rotating hook to cause the needle thread to be brought underneath the bobbin carrier, the bobbin carrier also dispensing bobbin thread from a bobbin spool within the bobbin carrier in cooperation with the rotating hook pulling on the needle thread;

cutting the needle thread first and second legs and cutting the bobbin thread forming a first leg connected with the bobbin and a second leg connected with the sewn material, and insuring a predetermined length of the needle thread first leg;

wiping the first leg of the needle thread insuring a minimum length of the first leg of the needle thread on a side of the throat plate adjacent the sewn material; and cutting the second leg of the needle thread and the bobbin thread at a position generally more adjacent to the material.

11. A method as described in claim 10 wherein the cutting of the second legs of the needle and bobbin threads is accomplished with an electric wire cutter having a multi-stage transformer having at least one hold temperature and a second elevated cutting temperature.

* * * * *